US005103971A

United States Patent [19]

Schuster

[11] Patent Number: 5,103,971

[45] Date of Patent: Apr. 14, 1992

[54] ARTICLE CARRIER

[75] Inventor: Richard L. Schuster, Monroe, La.

[73] Assignee: Riverwood Internationsl Corporation, Denver, Colo.

[21] Appl. No.: 717,788

[22] Filed: Jun. 14, 1991

[51] Int. Cl.[5] ..... B65D 75/00

[52] U.S. Cl. ..... 206/153

[58] Field of Search ..... 206/152, 153

[56] References Cited

U.S. PATENT DOCUMENTS

| | | | |
|---|---|---|---|
| 3,653,503 | 4/1972 | Arneson | 206/153 |
| 3,722,945 | 3/1973 | Wood | 206/153 X |
| 3,897,873 | 8/1975 | Graser | 206/153 |

*Primary Examiner*—William I. Price
*Attorney, Agent, or Firm*—Cornelius P. Quinn

[57] ABSTRACT

A carrier for articles such as beverage cans of the type that grip the top portions of the cans so as to suspend them from the carrier. The upper ends of the cans extend through apertures in the bottom panel of the carrier, and the chimes or lips of the cans are engaged by locking tabs surrounding the aperture. Glue flaps foldably connected to the bottom panel adjacent the can apertures by connecting flap segments overlie the upper ends of the cans. The connecting flap segments contain support tabs which assist in supporting the cans, thereby providing support substantially throughout the circumference of the cans.

14 Claims, 2 Drawing Sheets

ARTICLE CARRIER

FIELD OF THE INVENTION

This invention relates to article carriers. More particularly, it relates to article carriers that grip the upper portion of articles so as to suspend them from the carrier.

BACKGROUND OF THE INVENTION

Carriers that grip the upper portions of articles to enable the articles to be readily lifted and carried are well known. Their use in carrying beverage containers is particularly familiar, especially in connection with beverage cans. For example, plastic carriers which contain openings that fit over the tops of beverage cans so as to grip the cans in the reduced neck area just below the can chimes are often employed. Although economical to produce, such carriers have certain drawbacks. The thin plastic material at the finger holes can be painful to the user's fingers when the package is carried for any length of time. Further, the thin material required to enable the carrier to be forced over the tops of the cans limits the weight of the package. For these reasons plastic carriers are normally not used to carry more than six 12-ounce cans in a package. In addition, the use of such carriers provides no space for printed advertising material or other indicia. Further, discarded plastic carriers have been seen as creating environmental problems.

Paperboard carriers have been designed for carrying beverage containers in similar fashion, that is, by gripping the top portions of containers so that the suspended containers beneath that point are unenclosed. One such carrier design consists of a top panel spaced from a bottom panel by short side panels, with the tops of the beverage containers located in the space between the top and bottom panels. The containers are introduced to the carrier through apertures in the bottom panel and typically are held in place by support tabs which extend up from the bottom panel and engage the underside of the chimes or other form of outwardly extending lip on the container. Finger openings in the top panel, softened by flaps that shield the fingers from paperboard edges, enable the carrier to be lifted and carried without discomfort.

Paperboard carriers of this type are not only more comfortable to use, they are quite strong, are inexpensive to manufacture and are environmentally acceptable. Further, the substantially unbroken expanse of the top panel provides ample space for printed indicia. Certain designs, however, make it difficult to engage the container rim with support tabs throughout the circumference of the container. For example, it is desirable to provide glue flaps which extend up from the bottom panel and overlie a portion of the container tops, placing them in position to be glued to the top panel. Such glue flaps supplement the usual overlapping type of glue flap that runs along the edge portions of the carrier. Because space limitations require the supplemental glue flaps to be foldably connected to the bottom panel adjacent the aperture through which the containers extend, the flaps take up a significant circumferential portion of each aperture, so that there is no room for a support tab in that location. The lack of support for the container in this area is a potential weak spot in the carrier which should be eliminated. Until now, it was not known how to correct this problem in an economic manner without introducing still other problems.

SUMMARY OF THE INVENTION

A carrier for lifting and supporting a plurality of articles whose upper portions extend through apertures in the bottom panel of the carrier includes a plurality of support tabs foldably connected to the bottom panel adjacent the apertures. The support tabs extend generally toward the top panel, engaging outwardly projecting lips at the tops of the associated articles. In accordance with the invention, a flap overlying at least a portion of the upper surface of at least one article is foldably connected to the bottom panel by a connecting flap segment adjacent the periphery of the associated aperture between two spaced support tabs, and means are provided for engaging the lip on the article between the portions engaged by the two spaced support tabs to assist in supporting the article. Preferably, the means for engaging the lip comprises a support tab defined by slits in the connecting flap segment.

The support tab incorporated in the connecting flap segment is spaced from the two spaced support tabs by a relatively minor distance compared to the widths of the tabs, whereby the lip of the article is engaged by closely spaced support tabs extending substantially uniformly around the periphery of the article.

The features of the invention which enable it to provide the desired results are brought out in more detail below in connection with the preferred embodiment, wherein the above and other aspects of the invention, as well as other benefits, will readily become apparent.

DETAILED DESCRIPTION OF THE PREFERRED EMBODIMENT

Figure 1:
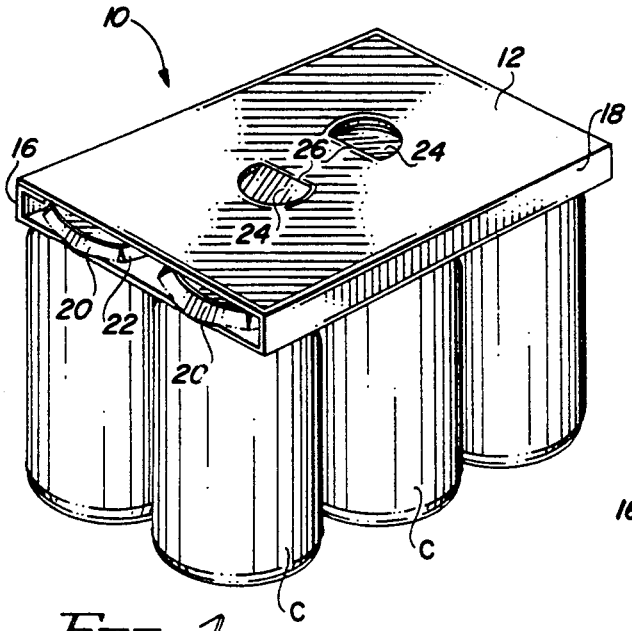
FIG. 1 is a pictorial view of a carrier incorporating the article support means of the present invention.

Referring to FIG. 1, a carrier 10 is comprised of a top panel 12 connected to bottom panel 14 by side panels 16 and 18. The upper portions of cans C extend through openings in the bottom panel 14, not visible in this view, and are held by a number of support tabs of which tabs 20 and 22 are visible. The side panels are very short, resulting in a quite small space between the top and bottom panels where the cans are supported. Finger holes covered by tabs 24 foldably connected to the top panel 12 along fold lines 26 are provided to facilitate lifting the carrier.

Figure 2:
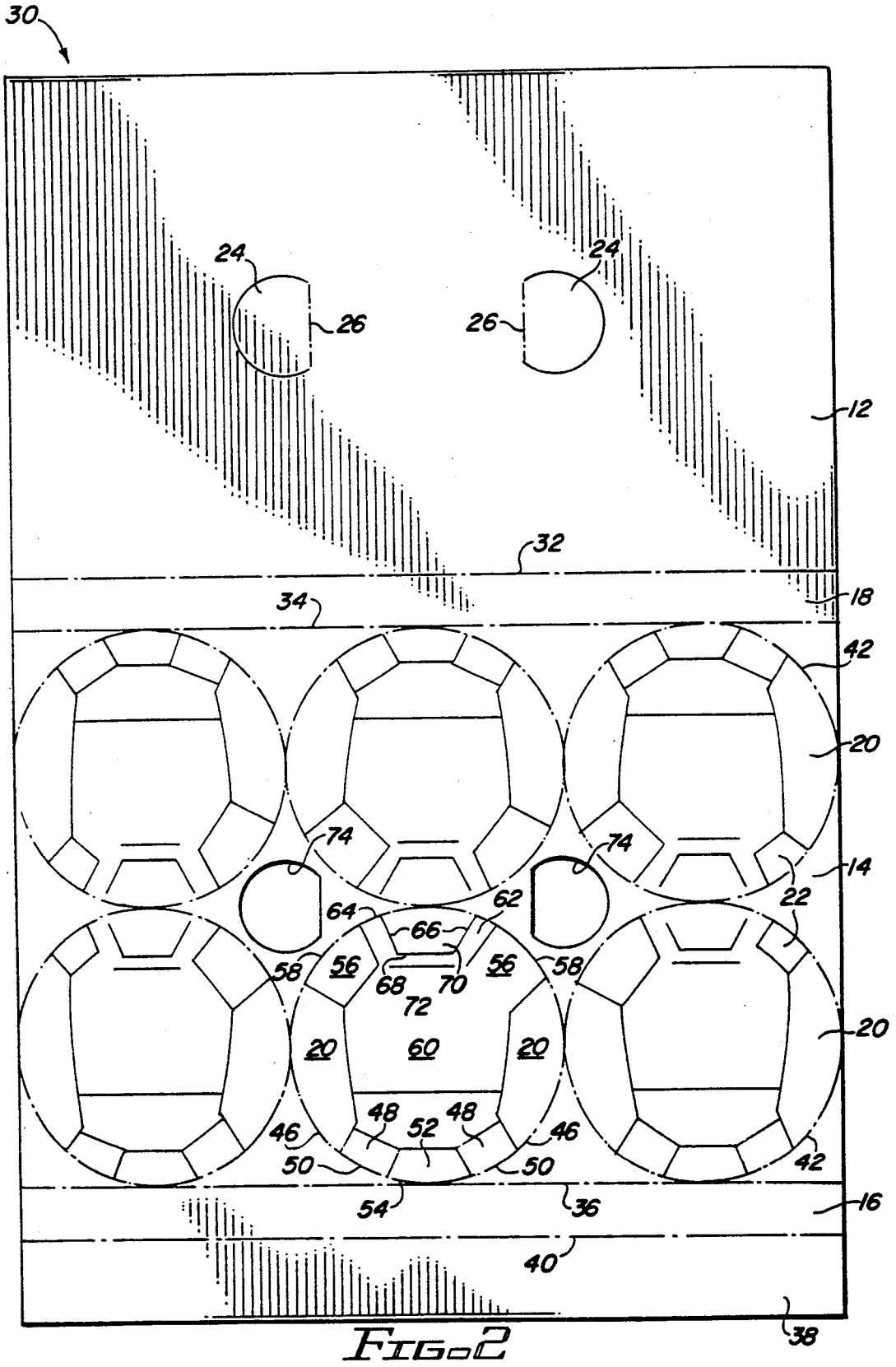
FIG. 2 is a plan view of a blank for forming the carrier of FIG. 1.

Referring to FIG. 2, wherein like reference numerals to those used in FIG. 1 denote like structure, the carrier is formed from blank 30, which is divided into a top panel section 12, a bottom panel section 14 and side panel sections 16 and 18. The side panel section 18 is connected to the top panel section 12 by fold line 32, and to the bottom panel section 14 by fold line 34. The side panel section 16 is connected to the bottom panel section 14 by fold line 36 and to glue flap 38 by fold line 40.

Because the carrier chosen to illustrate the invention is designed to carry six beverage cans, the bottom panel section 14 is provided with two adjacent rows of three adjacent apertures 42, making a cluster of six adjacent apertures. Each aperture is ringed by a series of support tabs connected to the bottom panel along fold lines coincident with the boundary of the aperture. Thus, each middle aperture 42 has support tabs 20 connected to the bottom panel 14 on opposite sides of the aperture along fold lines 46. Adjacent the outer side of the support tabs 20 are support tabs 48, connected to the bottom panel along fold lines 50, and between the tabs 48 is support tab 52, connected to the bottom panel along fold line 54. Adjacent the support tabs 20 on the opposite or interior side of the aperture are support tabs 56, connected to the bottom panel along fold lines 58. Extending between the ends of the tabs 56 and between substantial portions of the ends of the tabs 20 is a flap 60 which includes a connecting flap segment 62 connected to the bottom panel along fold line 64. The continuously extending fold lines 46, 50, 54, 58 and 64 coincide with the edge of the circular aperture 42. It will be understood that although the shape of the apertures and the fold lines is circular in order to receive cylindrical beverage cans, other shapes of apertures corresponding to the cross-section of different forms of articles could be provided as necessary.

The support tab arrangement for the end apertures is substantially the same as for the interior apertures just described. One slight difference is the fact that the tab 22 near the end of the carrier, corresponding to the tab 56, is narrower than the tab 56, and the large tabs 20 at the ends of the carrier is longer than the tabs 20 in the interior of the carrier. This arrangement allows the slit separating the tabs 22 and 20 to be located farther from the end edge of the carrier than would be a slit separating the tab 20 from a tab of the same width as the tabs 56, thereby increasing the distance between the end of the slit and the edge of the carrier and lessening the risk of tearing in this area. It will be noted that although the tabs extend radially inwardly from their fold lines for varying distances, with the longer tabs such as 20 extending farther than the shorter tabs 48, 52 and 22, all the tabs in a carrier formed from the blank will contact the lip of an associated container. The varying tab lengths merely take into account the curvature of the tabs after they have been pushed out of the plane of the bottom panel by a cylindrical container.

Within the connecting flap segment 62 are slits 66 which begin at a point slightly spaced from the fold line 64 and converge until they meet slit 68, the three slits forming a tab 70 shaped like an open-ended truncated triangle. Spaced from the slit 68, and arranged parallel to the slit 68 as well as to side panel sections 16 and 18, is a slit 72 the ends of which are spaced from the edges of the tabs 56. Finger holes 74 are provided in the interior areas of the bottom panel between the apertures 42 so that they are aligned with the finger holes in the top panel section 12 in a carrier formed from the carrier blank.

Figure 4:
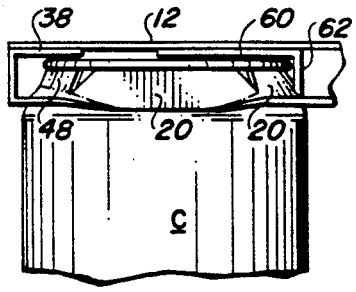
FIG. 4 is a partial end view of the carrier and container shown in FIG. 3.
Figure 3:
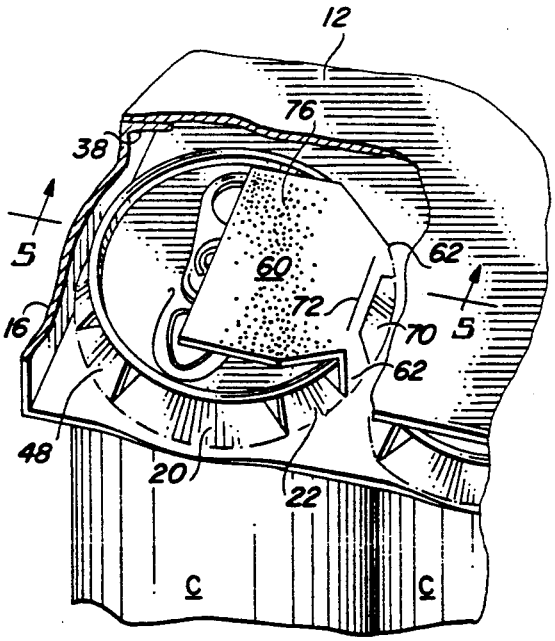
FIG. 3 is an enlarged partial pictorial view showing the support tabs of the invention engaging a container in a carrier.

In use, the blank of FIG. 2 is positioned on top of a group of six adjacent cans which have been arranged in two rows of three each so that the apertures overlie the cans. Relative movement between the apertures and the cans is caused by applying downward pressure to the bottom panel section. The relative upward movement of the tops of the cans pushes the support tabs up until they engage the bottom of the can chimes. The resiliency or memory of the tabs causes them to be biased toward the cans so that the support tab edges remain in contact with the underside of the can chimes. This condition is illustrated in more detail in FIGS. 3 and 4, which shows the tabs 48, 20 and 22 of an aperture contacting the underside of the chime of the associated can. As shown, the tabs are separated slightly as a result of their upward pivoting movement, but still are so closely spaced that they provide substantially continuous support around the circumference of the adjacent portion of the can chime.

Figure 5:
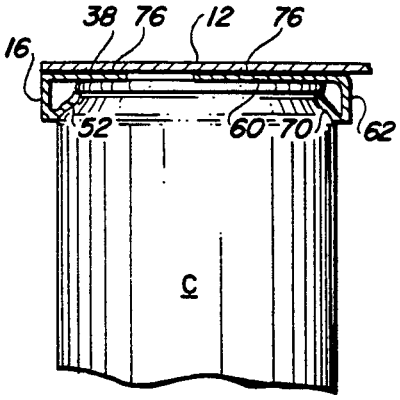
FIG. 5 is a partial longitudinal sectional view taken on line 5—5 of FIG. 3.
Figure 6:
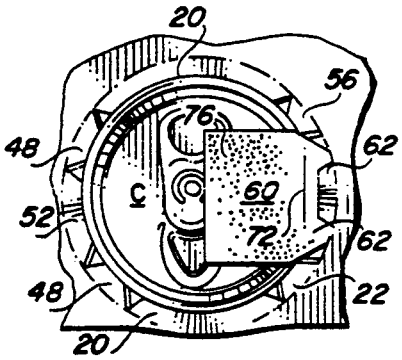
FIG. 6 is a partial plan view of the carrier and container shown in FIG. 3.

When relative movement of a can pushes the tabs up, the flap connecting segment 62 is also pivoted up, which causes the tab 70 formed by the slits 66 and 68 to be inwardly biased so that the tab edge contacts the underside of the chime in the same manner as the other support tabs. Thus the tab 70 provides support for a substantial portion of the can circumference which otherwise would be unsupported as a result of the space taken up between tabs by the connection between the glue flap 60 and the bottom panel. The engagement of the can chime by the support tab 70 is illustrated in FIG. 5. As can be seen in FIG. 6, which is a top view of the can without the top panel of the carrier but with the glue flap 60 in place, the support tabs provide support throughout the circumference of the can. Without the tab 70 a substantial portion of the can circumference would be unsupported.

After the blank has been moved down over the can tops to actuate the support tabs the blank is folded along lines 32, 34, 36 and 40 to form the side panels and to cause the outer edge portion of the top panel 12 to overlie the glue flap 38. This action folds the glue flaps 60 down along the fold line created by the slit 72 into their final position so that they engage the underside of the top panel. It will be understood that prior to the folding operation, glue 76, represented by the stippling in FIGS. 3 and 6 and shown also in cross-section in FIG. 5, will have been applied to either the glue flap 38 or the areas of the top panel that engage the glue flap 38, and also to either the glue flaps 60 or the areas of the top panel that engage the glue flaps 60.

It will be noted that the glue flaps 60 have been made quite long so that in the carrier they extend out to about the center of the can top. This accomplishes several things. It maximizes the area of the glue flaps 60 in order to strengthen the attachment of the top panel to the bottom panel, and the resulting strong connection between the glue flaps 60 and the top panel 12 lessens the chance of "gapping" or bowing of the top panel with respect to the bottom panel. Further, by making the flaps extend out to the center of the cans they will rest on the built-in can opening tabs T, shown in FIGS. 3 and 6, regardless of the orientation of the can in the package. Because the can opening tabs extend above the rest of the can top, this arrangement maintains the glue flaps at a more elevated position and in a more horizontal plane than a shorter flap would be and facilitates the application of sufficient pressure when gluing the top panel to the glue flaps.

To lift a package of cans, the user merely inserts the fingers through the finger holes in the top panel and the aligned finger holes 74 in the bottom panel. The tabs 24 are thereby also pushed down to a vertical position and function as supports for the fingers when lifting and carrying the package.

It will now be clear that the invention improves the strength of paperboard carriers designed to carry articles by their top portions, and guards against the articles coming loose by supporting them substantially entirely about their entire periphery. Obviously, although the invention has been described in connection with a carrier designed to hold six beverage containers the principles of the invention may be included in carriers designed to hold a lesser or greater number of articles.

It should also be appreciated that the invention need not necessarily be limited to all the specific details described in connection with the preferred embodiment, but that changes to certain features which do not alter the overall basic function and concept of the invention may be made without departing from the spirit and scope of the invention defined in the appended claims.

What is claimed is:

1. A carrier for supporting a plurality of articles each of which has an upper surface and an outwardly projecting lip adjacent the upper surface, comprising:

a top panel;

a bottom panel spaced from the top panel and connected thereto by side panels;

the bottom panel containing a plurality of apertures through which the upper portions of the articles extend;

a plurality of support tabs foldably connected to the bottom panel adjacent the apertures and extending generally toward the top panel, the support tabs engaging the lips of the associated articles;

a flap overlying at least a portion of the upper surface of at least one article;

a connecting flap segment foldably connected to one end of the flap and to the bottom panel adjacent the periphery of the associated aperture between two spaced support tabs; and means for engaging the lip on said one article between the portions engaged by said two spaced support tabs to assist in supporting said one article.

2. The carrier of claim 1, wherein the top panel is adhered to the bottom panel along overlapping edges thereof and is also adhered to the flap.

3. The carrier of claim 1, wherein the means for engaging the lip on said one article comprises a support tab defined by slits in the connecting flap segment.

4. The carrier of claim 3, wherein the support tab in the connecting flap segment is spaced from said two spaced support tabs a relatively minor distance compared to the widths of such tabs, whereby the lip of said one article is engaged by closely spaced locking tabs about the periphery thereof.

5. The carrier of claim 1, wherein the articles are arranged in two adjacent rows, each row containing a plurality of articles.

6. The carrier of claim 5, including a flap associated with each aperture, each flap overlying at least a portion of the upper surface of the associated article.

7. The carrier of claim 1, wherein at least the upper portions of the articles are cylindrical.

8. The carrier of claim 7, wherein the articles are beverage cans.

9. The carrier of claim 1, wherein a portion of the foldable connection between the flap and the connecting flap segment is defined by a slit.

10. A blank capable of being formed into a carrier for supporting a plurality of articles each of which has an upper surface and an outwardly projecting lip adjacent the upper surface, comprising:

a top panel section;

a bottom panel section;

a first side panel section between and foldably connected to the top and bottom panel sections;

a second side panel section foldably connected to one of the top or bottom panel sections;

a flap foldably connected to the second side panel section and adapted to be overlapped by and adhered to the other of the top or bottom sections;

the bottom panel section containing a plurality of apertures adapted to receive the upper portions of the articles;

a plurality of support tabs foldably connected to the bottom panel adjacent the apertures and adapted to be folded out of the plane of the bottom panel by articles being moved into position through the apertures and to engage the lips of the associated articles;

a flap foldably connected to the bottom panel adjacent at least one of the apertures, the flap adapted to be folded out of the plane of the bottom panel by an article being moved into position through said one aperture and further adapted to be folded down so as to overlie at least a portion of the upper surface of said article; and means incorporated in the flap for engaging the lip on said article to assist in supporting said one article in the carrier.

11. The carrier blank of claim 10, wherein the means for engaging the lip on said article comprises a support tab defined by slits in the flap.

12. The carrier blank of claim 11, wherein the support tab in the flap is spaced from adjacent support tabs a relatively minor distance compared to the widths of such tabs.

13. The carrier blank of claim 12, including a flap associated with each aperture, each flap being adapted to overlie at least a portion of the upper surface of an associated article.

14. The carrier blank of claim 13, wherein each flap has a length enabling the flaps to overlie at least about half the width of the top surface of the associated article.

* * * * *